US006805202B2

(12) United States Patent
Gillespie et al.

(10) Patent No.: US 6,805,202 B2
(45) Date of Patent: Oct. 19, 2004

(54) WELL SCREEN COVER

(75) Inventors: George Gillespie, Coon Rapids, MN (US); Robert Norrell, New Brighton, MN (US); Steve Rabb, New Richmond, WI (US); Phong Vu, The Woodlands, TX (US); Lars Brosdahl, Brooklyn Park, MN (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/036,713

(22) Filed: Dec. 21, 2001

(65) Prior Publication Data

US 2002/0117304 A1 Aug. 29, 2002

Related U.S. Application Data

(60) Provisional application No. 60/261,850, filed on Jan. 16, 2001.

(51) Int. Cl.[7] ..... E21B 43/08

(52) U.S. Cl. ..... 166/378; 166/233; 166/236; 166/242.3

(58) Field of Search ..... 166/227, 231, 166/233, 234, 236, 242.1, 242.3, 378

(56) References Cited

U.S. PATENT DOCUMENTS

| | | | | | |
|---|---|---|---|---|---|
| 2,046,459 | A | * | 7/1936 | Johnson | 166/233 |
| 3,709,293 | A | * | 1/1973 | Layne et al. | 166/232 |
| 4,068,713 | A | | 1/1978 | McGuire | |
| 4,096,911 | A | * | 6/1978 | Geske | 166/234 |
| 5,343,942 | A | | 9/1994 | Del Serra et al. | |
| 5,476,143 | A | | 12/1995 | Sparlin et al. | |
| 5,918,672 | A | * | 7/1999 | McConnell et al. | 166/233 |
| 5,921,285 | A | * | 7/1999 | Quigley et al. | 138/125 |
| 5,979,551 | A | * | 11/1999 | Uban et al. | 166/233 |
| 5,992,518 | A | * | 11/1999 | Whitlock | 166/235 |
| 6,135,209 | A | | 10/2000 | Uhlenkott | |
| 6,173,788 | B1 | * | 1/2001 | Lembcke et al. | 166/387 |
| 6,343,651 | B1 | * | 2/2002 | Bixenman | 166/278 |
| 6,361,299 | B1 | * | 3/2002 | Quigley et al. | 428/36.3 |
| 6,390,192 | B2 | * | 5/2002 | Doesburg et al. | 166/230 |
| 2002/0092649 | A1 | * | 7/2002 | Bixenman et al. | 166/278 |
| 2002/0125009 | A1 | * | 9/2002 | Wetzel et al. | 166/278 |

FOREIGN PATENT DOCUMENTS

| | | |
|---|---|---|
| GB | 2 348 224 A | 9/2000 |
| WO | WO 98/50680 A2 | 11/1998 |

* cited by examiner

*Primary Examiner*—Jennifer H. Gay
(74) *Attorney, Agent, or Firm*—Moser, Patterson & Sheridan, L.L.P.

(57) ABSTRACT

A well screen cover including a channel running along substantially the entire length of the well screen cover. The channel may be formed directly into the cover or separately formed and welded to the cover. The channel is open to the exterior of the well screen cover and is formed to house a cable, such as a fiber optic cable, which is run into a well bore along with the well screen.

20 Claims, 4 Drawing Sheets

WELL SCREEN COVER

CROSS-REFERENCE TO RELATED APPLICATIONS

This application claims priority under 35 U.S.C. §119 to Provisional Patent Application No. 60/261,850 filed on Jan. 16, 2001.

BACKGROUND AND SUMMARY OF THE INVENTION

The present invention relates to oil wells, gas wells, and water wells, and particularly to filters which are inserted into oil, gas, or water well bores. More particularly, the present invention relates to a protective cover for protecting a well screen as it is being inserted down a well bore.

Conventional well screens for filtering impurities out of oil, gas, or water include a perforated jacket or cover surrounding a filter medium or screen which filters impurities out of the oil, gas, or water. Typically, sections of well screen are linked together, end-to-end, to form a string which is inserted down a well bore. To drain a reservoir of oil, gas, or water most efficiently, it is desirable to monitor key parameters at various points along the string. For example, it is often desirable to monitor temperature, pressure, flow rate, and/or water content at various points along the well screen string.

Conventional well screens may utilize a fiber optic cable placed continuously along an exterior surface of the well screen cover to monitor these parameters. The fiber optic cable is fed into the well bore as multiple well screen segments are strung together and run into the well. Running a fiber optic cable into a well bore along with a well screen creates the potential for breakage of the fiber optic cable. A well screen cover structure which accommodates a fiber optic cable and helps prevent the cable from breaking would be welcomed by users of well screens.

According to the present invention, a well screen comprises a protective cover or jacket having a channel inset into an exterior surface of the cover and adapted to receive a fiber optic cable.

In preferred embodiments, the well screen cover includes the channel formed into the exterior surface of the cover and adapted to nest the fiber optic cable. The protective jacket or cover of the well screen is generally cylindrical, except for the preformed, channeled portion which creates a trough or channel inset from the exterior surface of the well screen to receive the fiber optic cable.

BRIEF DESCRIPTION OF DRAWINGS

The detailed description particularly refers to the accompanying figures in which.

DETAILED DESCRIPTION OF THE DRAWINGS

Figure 1:
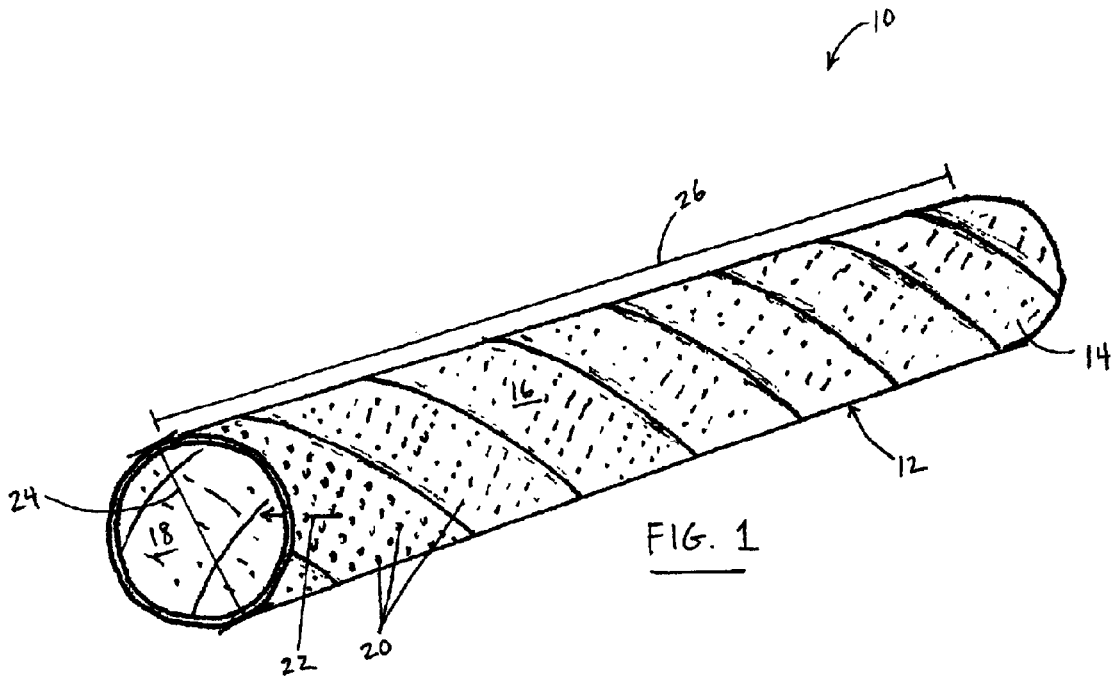
FIG. 1 is a perspective view of a perforated, cylindrical protective cover or jacket for an oil, gas, or water well screen, according to the present invention, prior to having a channel formed in it.

Referring to FIG. 1, a well screen cover 10, according to the present invention, begins as a spirally-formed, cylindrical tube 12. The tube 12 is formed from a single, spirally-wound strip of metal 14. The well screen cover 10 includes an outer surface 16, an inner surface 18 and multiple perforations 20 defining flow paths 22 from the outer surface 16 to the inner surface 18. According to a presently preferred embodiment, as shown in FIG. 1, the well screen cover 10 begins as a cylindrical tube with an outer diameter 24 of approximately 6.94 inches and includes perforations 20 with diameters of approximately 0.50 inches.

The well screen cover 10 represents a single "link" which is coupled to other links (not shown) to create a "string," which is inserted into an oil, gas, or water well bore. The well screen cover 10 protects a filter medium and base pipe (both not shown), which are positioned within the well screen cover 10. In preferred embodiments, the well screen cover 10 has a length 26 of approximately 15.75 feet.

Figure 1A:
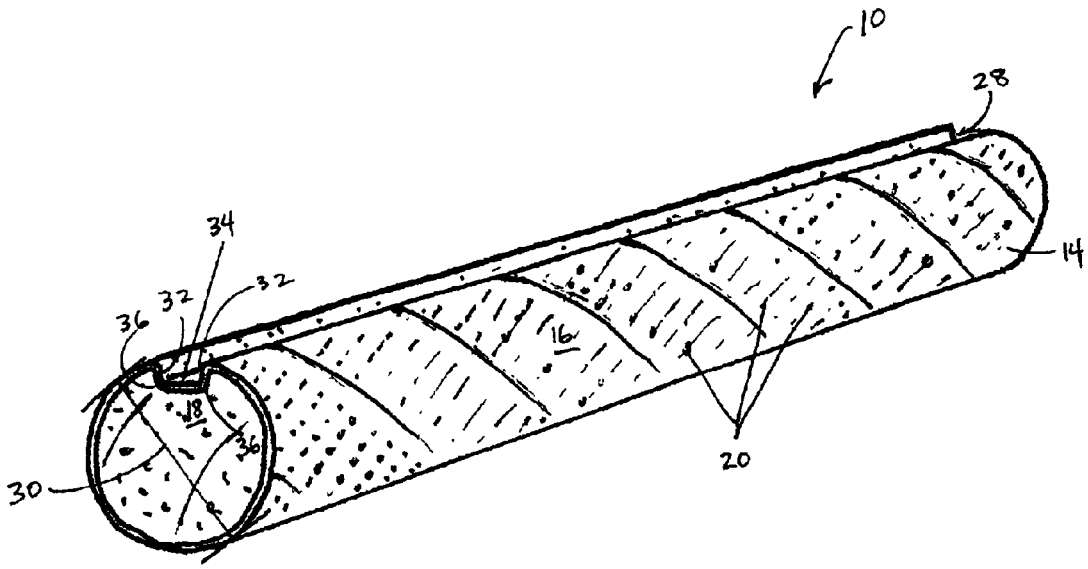
FIG. 1A is a perspective view of the well screen cover of FIG. 1, according to the present invention, after the channel has been formed in it.

Once the cylindrical tube 12 has been formed as described above, a press brake is used to form a channel 28 in the tube 12, as seen in FIG. 1A. The press brake (not shown) deforms the cylindrical tube 12, as shown in FIG. 1, to create the well screen cover 10 according to the present invention, as shown in FIG. 1A. Because the channel 28 is created in the well screen cover 10 by deforming the cylindrical tube 12, the resulting well screen cover 10, as shown in FIG. 1A, has a smaller diameter than the cylindrical tube 12, prior to deformation, as shown in FIG. 1. As can be seen with reference to FIGS. 1 and 1A, the diameter 24 of the cylindncal tube 12 decreases to the diameter 30 as a result of the formation of channel 28. For example, in a preferred embodiment, the diameter 30 of the well screen cover 10, as shown in FIG. 1A, is approximately 6.74 inches. This diameter can be used in an 8.5 inch open bore hole. It will be readily apparent to one of ordinary skill in the art that other diameters can be used in larger or smaller (e.g. 6⅛ inch) open bore holes.

Referring to FIG. 1A, the channel 28 includes two sidewalls 32, a floor 34, and inner radii 36 at the intersections of the floor 34 and the two sidewalls 32. According to a preferred embodiment of the invention as shown in FIG. 1A, when the well screen cover 10 is manufactured using a press brake as described above, each radius 36 has a diameter of approximately 0.25 inches. In this way, the well screen cover 10 maintains a substantially round cross-section, except for the channel 28. It will be readily understood by one of ordinary skill in the art that the diameter 30 of well screen cover 10 after formation of the channel 28 may vary to accommodate different sizes of well screens. Further, as will also be readily apparent to one of ordinary skill in the art, the channel 28 may be formed with different length sidewalls 32 and floor 34 and different sized radii 36 to create different sized channels 28 to accommodate various sizes of fiber optic cable. And, it will be readily understood that these variations will occur in response to various types and sizes of press brakes.

Figure 2:
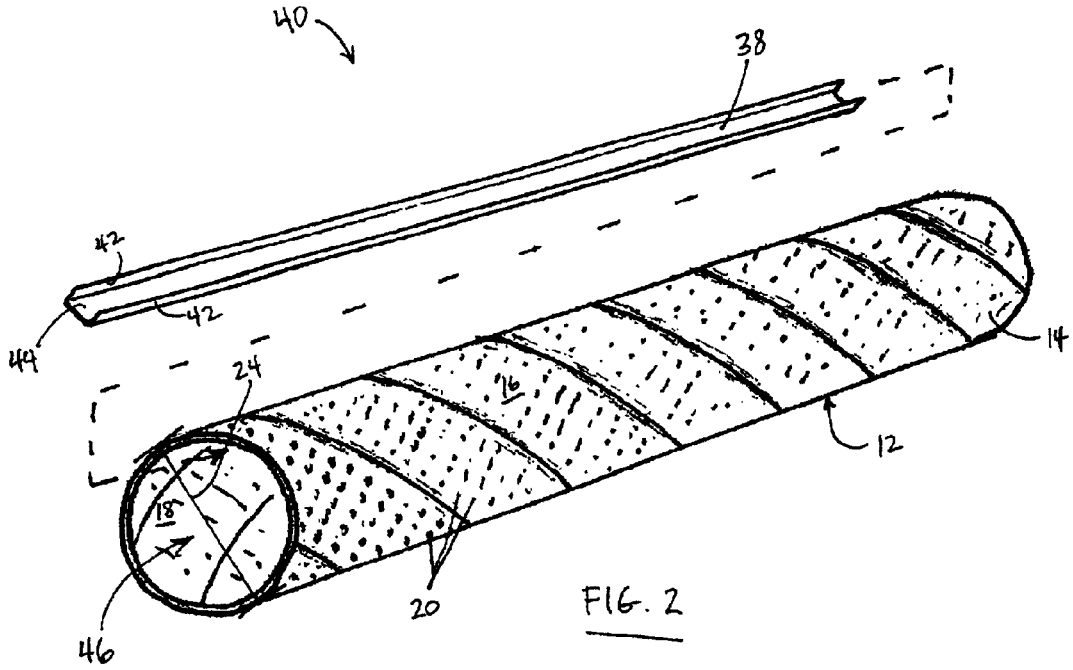
FIG. 2 is a perspective view of another embodiment of a well screen cover according to the present invention, showing a preformed channel being inserted into the well screen cover.
Figure 2A:
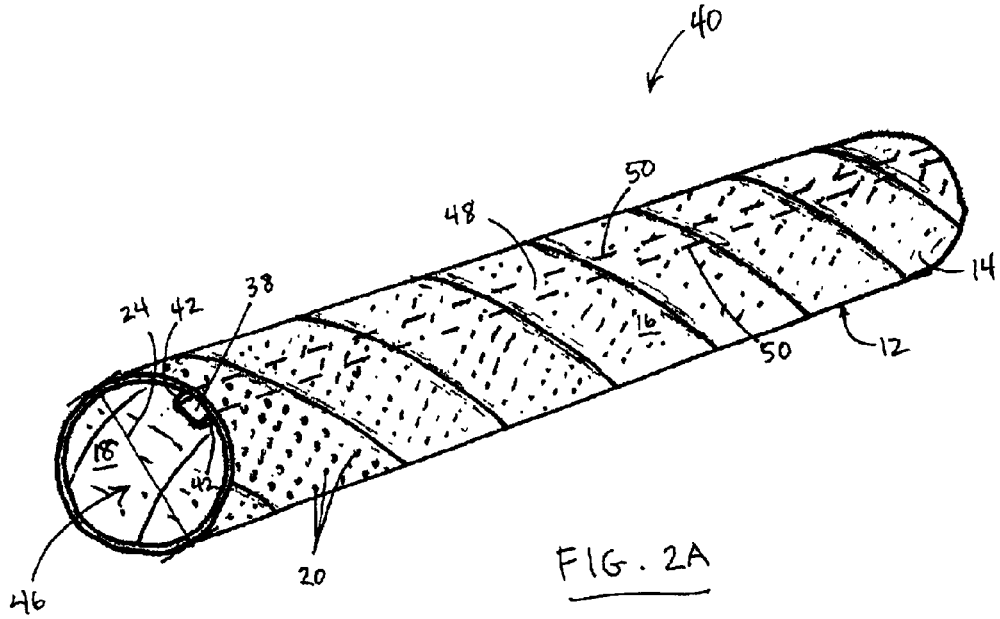
FIG. 2A is a perspective view of the well screen cover of FIG. 2, showing the channel welded to an inner surface of the well screen cover and indicating a portion of the well screen cover to be removed from between the sidewalls of the channel.

FIG. 2 illustrates a second embodiment of a well screen cover 40, according to the present invention. Again, as with the well screen cover 10, the well screen cover 40 begins with the cylindrical tube 12, formed from a single, spirally-wound strip of metal 14. However, unlike the well screen cover 10, wherein the tube 12 is preformed to include the channel 28, as shown in FIG. 1A, the well screen cover 40 includes a separately preformed channel 38, as shown in FIG. 2. As with the channel 28 formed in the well screen cover 10, the preformed channel 38 includes two sidewalls 42 and a floor 44. The channel 38 is inserted into an interior space 46 defined by the inner surface 18 of the spirally-formed, cylindrical tube 12. After being inserted into the interior space 46, the channel 38 is welded to the inner surface 18, as shown in FIG. 2A. Once the channel 38 is welded to the inner surface 18 of the spirally-formed, cylindrical tube 12, a portion 48 of the tube 12 is cut out between the two sidewalls 42 of the channel 38. As shown in FIG. 2A, the portion of the tube 48 which is removed to expose the channel 38 is indicated by dashed lines 50. Unlike the well screen cover 10, shown in FIG. 1A, the tube 12 is not deformed in the formation of the well screen cover 40. Therefore, unlike the well screen cover 10, the outer diameter 24 of the tube 12 remains substantially unchanged. The welding of the channel 38 to the inner surface 18 of the tube 12, as shown in FIG. 2A, does not substantially change the outer diameter 24 of the tube 12. Additionally, it will be readily apparent to one of ordinary skill in the art that the channel 38 is approximately the same length as the tube 12. Therefore, after the portion 48 of the tube 12 is removed, as described above, the well screen cover 40 includes an open channel running substantially the entire length of tube 12. However, the channel 38 could be formed to be longer or shorter than tube 12 to create various coupling arrangements at the ends of the well screen cover 40 for coupling multiple well screen segments together.

Figure 3:
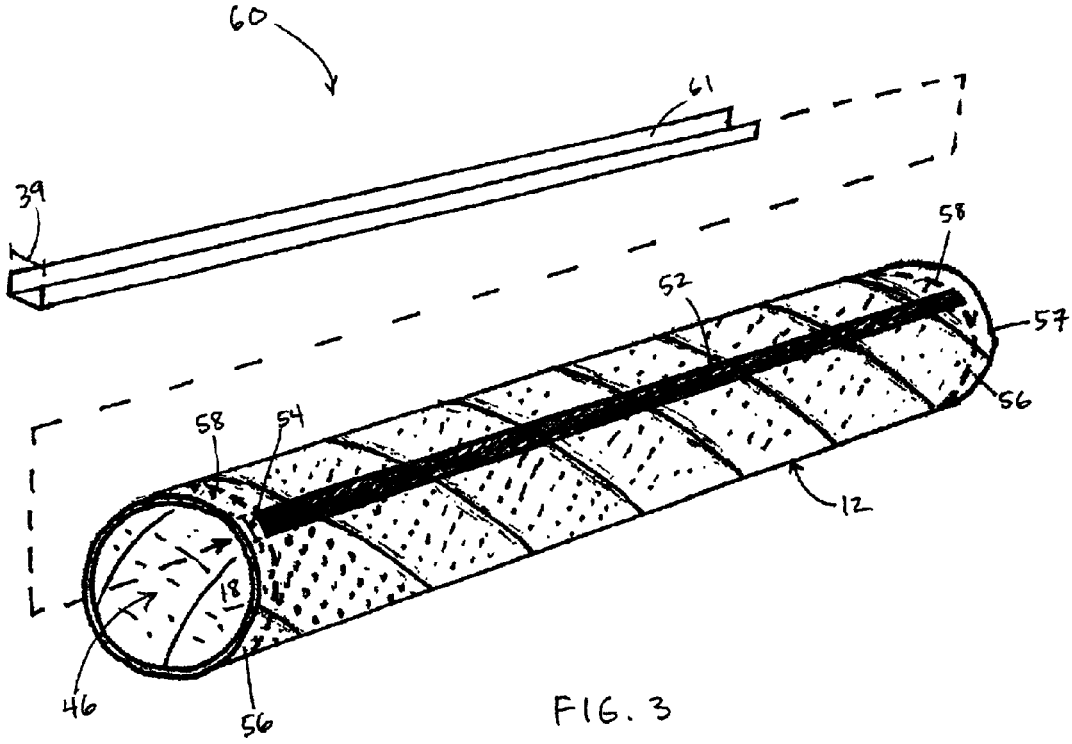
FIG. 3 is a perspective view of a third embodiment of a well screen cover according to the present invention, showing a preformed channel being inserted into the well screen cover beneath a slot that has been cut into the well screen cover.

A third embodiment of a well screen 60, according to the present invention, is shown in FIG. 3. Like the well screen cover 10 (FIG. 1A) and the well screen cover 40 (FIG. 2A), the well screen cover 60 (FIG. 3) begins with the spirally-formed, cylindrical tube 12. However, unlike the well screen cover 40, a longitudinal slot 52 is cut through the cylindrical tube 12 before a preformed channel 61 is inserted into the interior space 46 defined by the inner surface 18 of the cylindrical tube 12. The slot 52 has a width 54 approximately equal to a width 39 of the preformed channel 61. Further, as seen in FIG. 3, the slot 52 is approximately the same length as the channel 61 and both are slightly shorter than the tube 12. In this way, an approximately one inch wide band 56, into which the slot 52 does not extend, remains at each end of the tube 12. The bands 56 hold the tube 12 round when the slot 52 is cut into the tube 12. Then, once the slot 52 has been cut into and through the tube 12, the channel 61 is placed into the interior space 46 and welded to the inner surface 18 beneath the slot 52. As mentioned, channel 61 is approximately the same length as the slot 52. Therefore, the slot 52 provides access to the open, preformed channel 61 along its entire length. With the channel 61 thus welded to the inner surface 18 of the tube 12, the bands 56 are cut off of the tube 12 approximately one inch from an edge 57 at each end of the tube, as indicated by dotted lines 58 in FIG. 3. In this way, the tube 12 is held round by the one inch bands 56, which are left intact at each end of the tube 12 while the channel 61 is being welded beneath the slot 52. However, once the channel 61 is welded in place, as mentioned, the one inch bands 56 are cut off along dotted lines 58 so that channel 61 extends from end-to-end of the resulting well screen cover 60 and is exposed along its entire length. Again, one of ordinary skill in the art will recognize that the length of the slot 52 and the channel 61 may be varied to create various coupling arrangements at the ends of the well screen cover 60 to facilitate the coupling together of multiple well screen cover segments.

Figure 4:
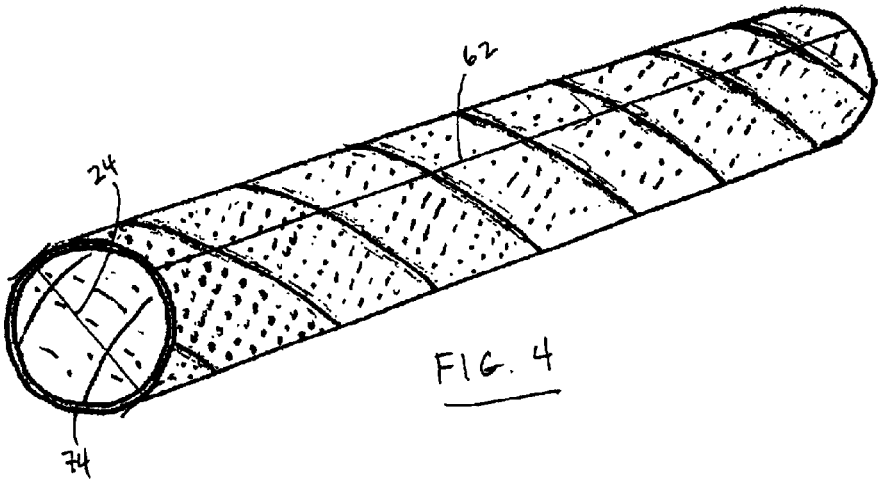
FIG. 4 is a perspective view of a fourth embodiment of a well screen cover according to the present invention, showing the well screen cover split along its length.
Figure 4A:
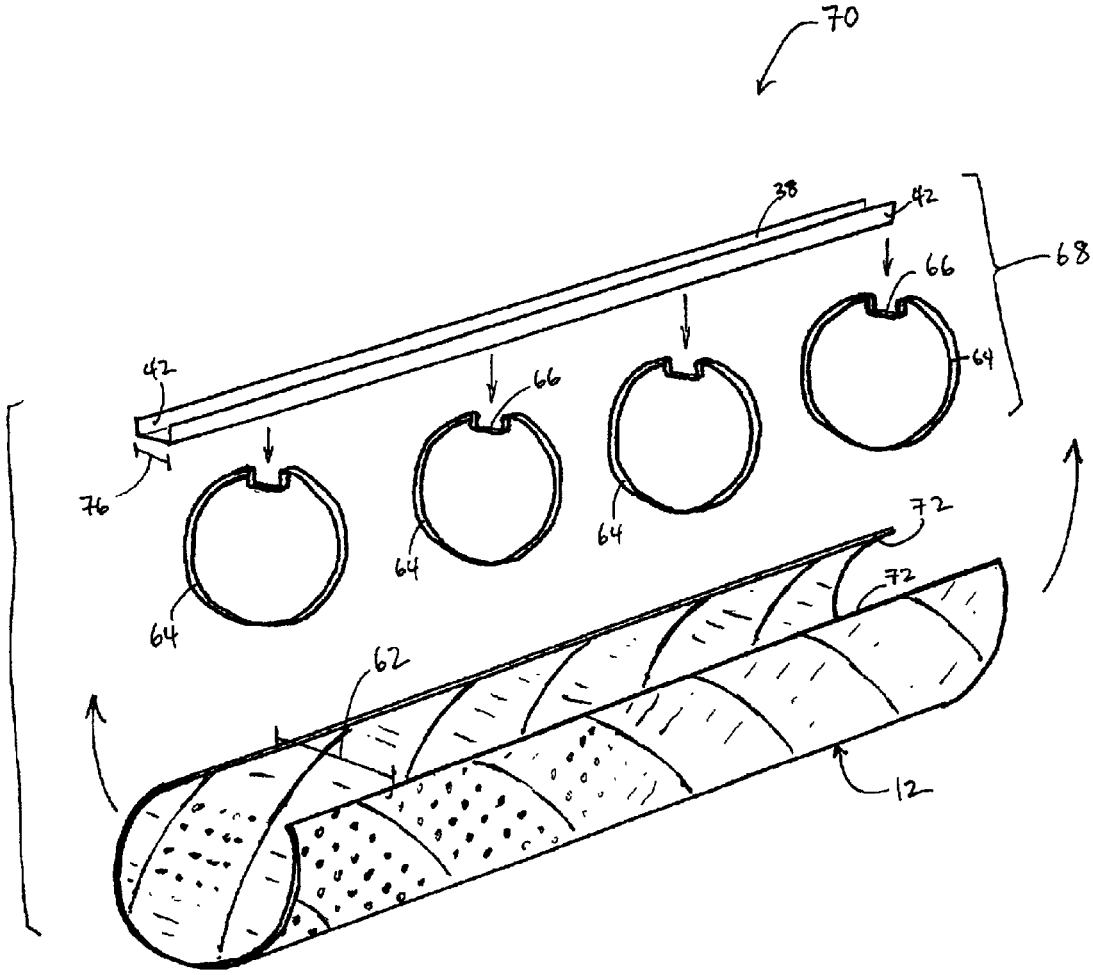
FIG. 4A is a perspective view of the well screen cover of FIG. 4 being wrapped around a series of rings welded to the preformed channel.

FIGS. 4 and 4A illustrate yet another embodiment of a well screen cover 70 according to the present invention. Again, as with well screen covers 10, 40 and 60, the well screen cover 70 begins as a spirally-formed, cylindrical tube 12, as shown in FIG. 4. The tube 12 is slit lengthwise along line 62, shown in FIG. 4. Once the tube 12 is slit along line 62, it is pried open, as shown in FIG. 4A, and is positioned around a series of support rings 64, which are welded to the preformed channel 38. The preformed channel 38 fits down into notches 66 formed in the support rings 64 to create subassembly 68. The channel 38 is then welded to support rings 64 to secure subassembly 68. Subassembly 68 is then surrounded by the cylindrical tube 12, which, as mentioned, is first split and pried open so that it can be positioned around subassembly 68. The tube 12 is then welded to rings 64 and channel 38 so that each edge 72 of the slit 62 cut into tube 12 is positioned adjacent the sidewalls 42 of channel 38, thereby leaving the channel 38 exposed after the tube 12 is positioned around and welded to the subassembly 68. As will be readily apparent to one of ordinary skill in the art, the diameter of the resulting well screen cover 70 is greater than the diameter 24 of the tube 12, as seen in FIG. 4, before it has been pried open. This is because, as shown in FIG. 4A, the perimeter 74 of the tube 12 (FIG. 4) is increased by approximately the width 76 of the channel 38 when the channel 38 is positioned in the slit 62.

In each of the four embodiments of the present invention depicted in FIGS. 1 through 4A, a channel is created in the well screen cover and is exposed along its entire length so that a continuous fiber optic cable can be laid in the channel. In each of the methods for manufacturing a well screen cover according to the present invention as depicted in FIGS. 1 through 4A, the length of the channel is substantially the same as the eventual length of the manufactured well screen cover. However, it will be readily understood by one of ordinary skill in the art that the channel could be shorter or longer than the resulting well screen cover to facilitate particular methods of coupling together consecutive segments of the well screen string.

Although the invention has been described in detail with reference to certain preferred embodiments, variations and modifications exist within the scope and spirit of the invention as described and defined in the following claims.

What is claimed is:

1. A well screen cover, comprising:

a perforated tube; and a channel having a floor and walls, wherein the floor and walls are defined by the perforated tube and disposed substantially along the length of the perforated tube.

2. The well screen cover of claim 1, wherein the channel is formed to house a fiber optic cable.

3. The well screen cover of claim 1, wherein the tube is formed of a spirally wound strip of metal.

4. The well screen cover of claim 3, wherein the channel is formed to house a fiber optic cable.

5. The well screen cover of claim 4, wherein the channel comprises an open surface facing radially outward.

6. The well screen cover of claim 1, wherein the channel is defined on an outer surface of the perforated tube.

7. The well screen cover of claim 1, wherein the channel is formed by press braking the channel along the length of the perforated tube.

8. The well screen cover of claim 1, wherein the channel comprises an open surface facing radially outward.

9. A well screen cover, comprising:

a tube having a plurality of perforations disposed therethrough; and a preformed channel coupled to the tube and disposed substantially along the length of the tube, wherein the channel comprises an open surface facing radially outward.

10. The well screen cover of claim 9, wherein the channel defines a floor and sidewalls, wherein the floor and the sidewalls are made from the same material as the perforated tube.

11. The well screen cover of claim 9, wherein the channel is made from a material different from the perforated tube.

12. The well screen cover of claim 9, wherein the channel defines sidewalls having upper portions coupled to an inner surface of the perforated tube.

13. The well screen cover of claim 9, wherein the channel defines sidewalls having upper portions welded to an inner surface of the perforated tube.

14. The well screen cover of claim 9, further comprising at least one support ring disposed along the periphery of an inside surface of the perforated tube.

15. The well screen cover of claim 14, wherein the at least one support ring is configured to support the channel and the perforated tube.

16. The well screen cover of claim 9, wherein the channel is formed to house a fiber optic cable.

17. The well screen cover of claim 9, wherein the tube is formed of a spirally wound strip of metal.

18. The well screen cover of claim 17, wherein the channel is preformed to house a fiber optic cable.

19. A method of completing a wellbore, comprising:

providing a well screen cover in the wellbore, wherein the cover comprises a perforated tube and a channel having a floor and walls, wherein the floor and walls are defined by the perforated tube and disposed substantially along the length of the perforated tube;

placing a fiber optic cable continuously along an exterior surface of the wellscreen; and running the fiber optic cable and the well screen cover into the wellbore without substantially damaging the fiber optic cable.

20. A method of completing a wellbore, comprising:

providing a well screen cover in the wellbore, wherein the cover comprises a tube having a plurality of perforations disposed therethrough and a preformed channel coupled to the tube and disposed substantially along the length of the tube, wherein the channel comprises an open surface facing radially outward;

placing a fiber optic cable continuously along an exterior surface of the wellscreen; and running the fiber optic cable and the well screen cover into the wellbore without substantially damaging the fiber optic cable.

* * * * *